US009751094B2

(12) United States Patent
Gardiner et al.

(10) Patent No.: US 9,751,094 B2
(45) Date of Patent: Sep. 5, 2017

(54) DISTRIBUTOR FOR A SCROLL SCREEN CENTRIFUGAL SEPARATOR

(71) Applicant: FLSmidth A/S, Valby (DK)

(72) Inventors: Michael J. Gardiner, Capalaba (AU); Mathew Walker, Camp Hill (AU); Tony Elliott, Wakerley (AU); David Starr, Forest Lake (AU); Craig Wilson, Cleveland (AU); Mark Flanagan, Metford (AU); Barry Lewis, Thornton (AU)

(73) Assignee: FLSmidth A/S (DK)

( * ) Notice: Subject to any disclaimer, the term of this patent is extended or adjusted under 35 U.S.C. 154(b) by 0 days.

(21) Appl. No.: 15/104,173

(22) PCT Filed: Dec. 17, 2014

(86) PCT No.: PCT/IB2014/067033

§ 371 (c)(1),
(2) Date: Jun. 13, 2016

(87) PCT Pub. No.: WO2015/092715

PCT Pub. Date: Jun. 25, 2015

(65) Prior Publication Data

US 2016/0310970 A1 Oct. 27, 2016

Related U.S. Application Data

(60) Provisional application No. 61/917,656, filed on Dec. 18, 2013, provisional application No. 61/976,800, (Continued)

(51) Int. Cl.
*B04B 3/00* (2006.01)
*B04B 11/06* (2006.01)
(Continued)

(52) U.S. Cl.
CPC ..... *B04B 11/06* (2013.01); *B04B 3/00* (2013.01); *B04B 3/04* (2013.01); *B04B 2001/2033* (2013.01)

(58) Field of Classification Search
CPC ..... F04D 29/2216; F04D 29/2255; F04D 29/2288; F04D 29/24; F04D 29/242;
(Continued)

(56) References Cited

U.S. PATENT DOCUMENTS 1,383,354 A * 7/1921 Wareing ..... F04D 29/2255 415/914
1,873,974 A * 8/1932 Meyer ..... F04D 29/284 416/186 R
(Continued)

FOREIGN PATENT DOCUMENTS

CN 201644238 U 11/2010
GB 2030225 A * 4/1980 ..... F04D 29/242

OTHER PUBLICATIONS

International Search Report and Written Opinion dated Apr. 7, 2015, 9 pages.

*Primary Examiner* — David C Mellon
(74) *Attorney, Agent, or Firm* — Matthew R. Weaver; Daniel DeJoseph; Jeffrey A. Sharp

(57) ABSTRACT

A scroll screen centrifugal separator includes a distributor that is configured to receive slurry received from a feed conduit. The distributor is configured to deflect the received slurry to a screen of the scroll screen centrifugal separator. In some embodiments, the distributor may include a distributor that has a flat surface encircled by a lip or having one or more lips positioned on the flat surface, an inclined surface, or a declined surface that faces the mouth of the feed conduit. In other embodiments, the distributor may include a plurality of dam members for defining passageways through which slurry is passable through the distributor prior
(Continued)

to being ejected to a screen of the separator. In other embodiments, the distributor may include a distributor plate that has a plurality of radial arms attached thereto that are configured to direct slurry to the basket with a rotational velocity.

19 Claims, 11 Drawing Sheets

Related U.S. Application Data filed on Apr. 8, 2014, provisional application No. 62/047,115, filed on Sep. 8, 2014.

(51) Int. Cl.
*B04B 3/04* (2006.01)
*B04B 1/20* (2006.01)

(58) Field of Classification Search
CPC ..... F04D 29/245; F04D 7/04; F04D 29/2211; F04D 29/2227; F04D 29/2238; B04B 3/00; B04B 3/02; B04B 11/06; B04B 3/04; B04B 2001/2033
USPC ..... 416/186 R, 223 B, 195, 196 R, 196 A, 416/189, 192, 193 R
See application file for complete search history.

(56) References Cited

U.S. PATENT DOCUMENTS

| | | | | |
|---|---|---|---|---|
| 2,571,711 | A * | 10/1951 | Hackman | F04D 29/2255 415/216.1 |
| 2,737,898 | A * | 3/1956 | Andermatt | F04D 29/2216 415/76 |
| 2,763,258 | A * | 9/1956 | Hughes | B28D 1/121 125/15 |
| 4,664,592 | A * | 5/1987 | Grzina | F04D 29/2266 415/171.1 |
| 5,498,136 | A * | 3/1996 | Namura | F01D 5/225 416/190 |
| 6,210,116 | B1 * | 4/2001 | Kuczaj | F04D 1/00 416/185 |
| 6,241,901 | B1 | 6/2001 | Leung | |
| 7,032,759 | B2 | 4/2006 | Reinach et al. | |
| 2010/0120598 | A1 * | 5/2010 | Angus | B04B 3/04 494/36 |

* cited by examiner

DISTRIBUTOR FOR A SCROLL SCREEN CENTRIFUGAL SEPARATOR

CROSS-REFERENCE OF RELATED APPLICATIONS

This application is an international application which claims the benefit of U.S. Provisional Patent Application Nos. 61/917,656 filed on 18 Dec. 2013; 61/976,800 filed on 8 Apr. 2014 and 62,047,115 filed on 8 Sep. 2014.

FIELD OF THE INVENTION

The present invention relates to centrifugal devices. More particularly, the present invention relates to distributors that may be utilized in scroll screen centrifugal separators such as a horizontal scroll screen centrifuge or a vertical scroll screen centrifuge.

BACKGROUND OF THE INVENTION

Examples of centrifuge related apparatuses may be appreciated from U.S. Pat. Nos. 1,334,023, 1,664,769, 1,903,795, 2,370,353, 2,727,631, 2,752,043, 3,087,621, 3,302,895, 3,307,703, 3,315,810, 3,361,264, 3,411,631, 3,418,097, 3,782,643, 3,837,913, 4,063,959, 4,922,625, 4,961,722, 5,426,866, and 5,616,245, and U.S. Patent Application Publication No. 2011/0006016. Some types of centrifugal devices may be used to pulverize rock or other material to a smaller size. Other types of centrifugal devices may be utilized to separate different materials.

For example, scroll screen centrifuges may be utilized in some environments to separate liquid from solid particulate material. For example, U.S. Pat. No. 8,257,587 discloses a scroll screen centrifuge that is configured to receive slurry and separate solid particulates from the liquid of the slurry. As another example, U.S. Pat. Nos. 3,428,246, 5,256,289, and 5,410,795 disclose vertical centrifuges configured to separate solid material from the liquid of a slurry.

Scroll screen centrifuges can be configured to utilize a basket that is rotated at one speed and scroll that is rotated at a different speed to help facilitate the separation of solid particulates from a liquid. During operations, the basket often experiences extensive wear in certain localized zones. As a result, the basket may need to be replaced regularly. Replacing the basket can incur costs and undesirably stoppages in operation as the operator of the centrifuge shut the centrifuge down for a period of time to remove an old basket and replace it with a new one.

SUMMARY OF THE INVENTION

A distributor for a scroll screen centrifugal separator is provided. In some embodiments, the distributor may include a first plate having a substantially flat surface for facing toward a mouth of a feed conduit when the first plate is attached within a scroll screen centrifugal separator. The substantially flat surface may be inclined or declined such that a peripheral portion of the first plate is thicker than an inner portion of the plate member.

Other embodiments of the distributor for a scroll screen centrifugal separator may include a first plate having a surface, an opening for receiving slurry and at least one lip attached to the first plate. Each lip may be configured to extend from the surface toward a mouth of a feed conduit such that an outermost portion of the lip is located closer to the mouth of the feed conduit as compared to the flat surface of the first plate when the distributor is mounted in a scroll screen centrifugal separator. The outermost portion of each lip may define an outermost surface of the lip that is inclined, declined, staged, stepped, or curved. Some embodiments of the distributor may only have one lip while other embodiments may have two or more lips that are spaced apart from each other. Yet other embodiments of the distributor may have multiple lips at different heights or having different inclined, declined, curved, or flat surfaces that are directly contacting each other to define a stepped or staged set of lips that form a unitary, integral A distributor for a scroll screen centrifugal separator is also provided that includes a first plate having an opening for receiving slurry, a second plate spaced apart from the first plate, and a plurality of spaced apart dam members attached to at least one of the first plate and the second plate to define passageways extending from adjacent the opening of the first plate to adjacent an outer edge of the second plate. The dam members can be spaced apart from each other such that immediately adjacent dam members define a passageway such that slurry received by the opening of the first plate is passable through the passageway toward an outlet of the distributor for directing the slurry from the outlet to a screen assembly of a scroll screen centrifugal separator.

A scroll screen centrifugal separator is also provided. The separator can include any embodiment of the distributor.

Other details, objects, and advantages of the invention will become apparent as the following description of certain present preferred embodiments thereof and certain present preferred methods of practicing the same proceeds.

BRIEF DESCRIPTION OF THE DRAWINGS

Exemplary embodiments of a scroll screen centrifugal separator and distributor for use in scroll screen centrifugal separators are shown in the accompanying drawings and certain exemplary methods of practicing the same are also illustrated therein. It should be understood that like reference numbers used in the drawings may identify like components.

DETAILED DESCRIPTION OF EXEMPLARY EMBODIMENTS

Figure 1:
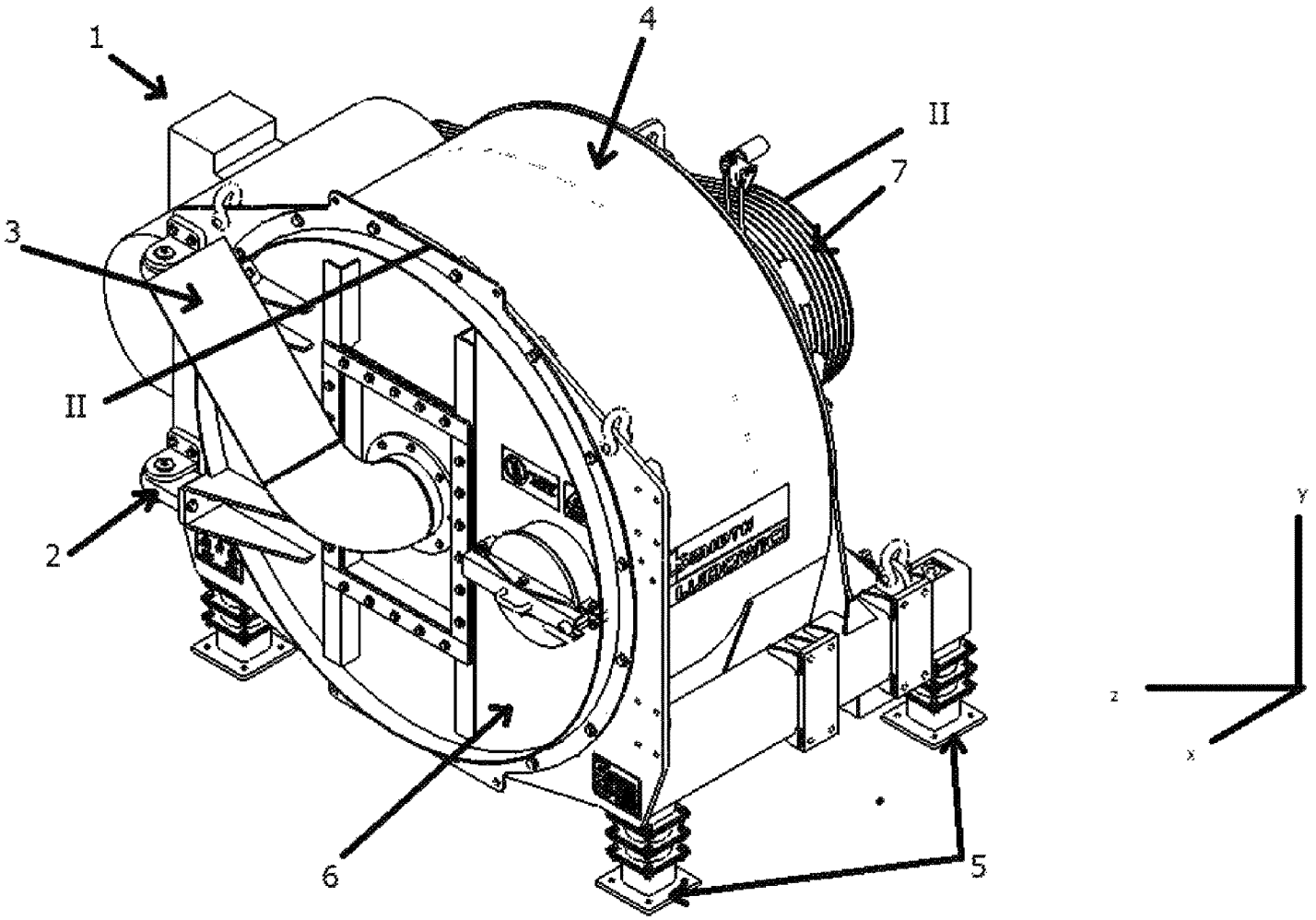
FIG. 1 is a perspective view of a first exemplary embodiment of a scroll screen centrifugal separator.
Figure 2:
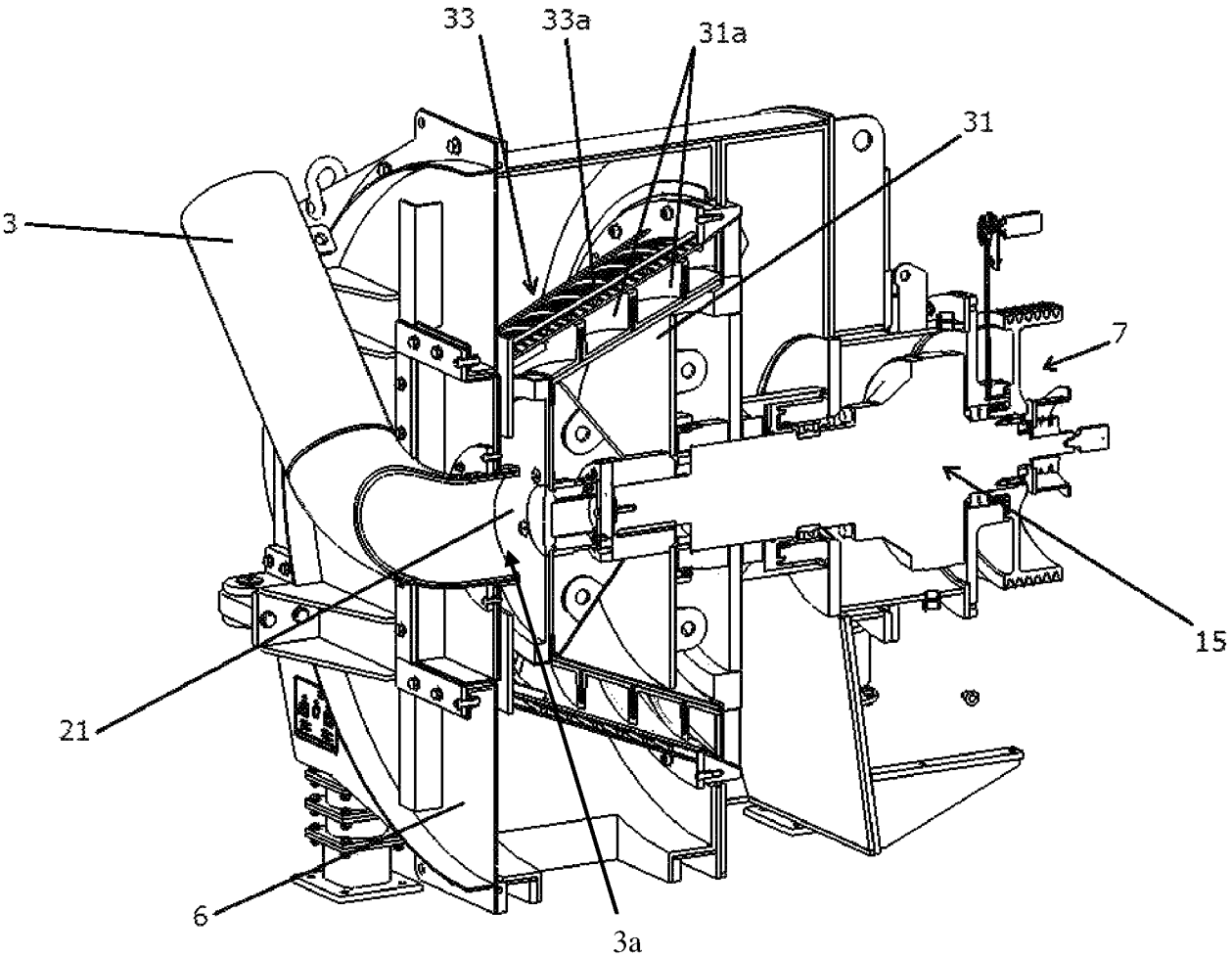
FIG. 2 is a cross sectional view of the first exemplary embodiment of the scroll screen centrifugal separator taken along line II-II shown in FIG. 1.
Figure 3:
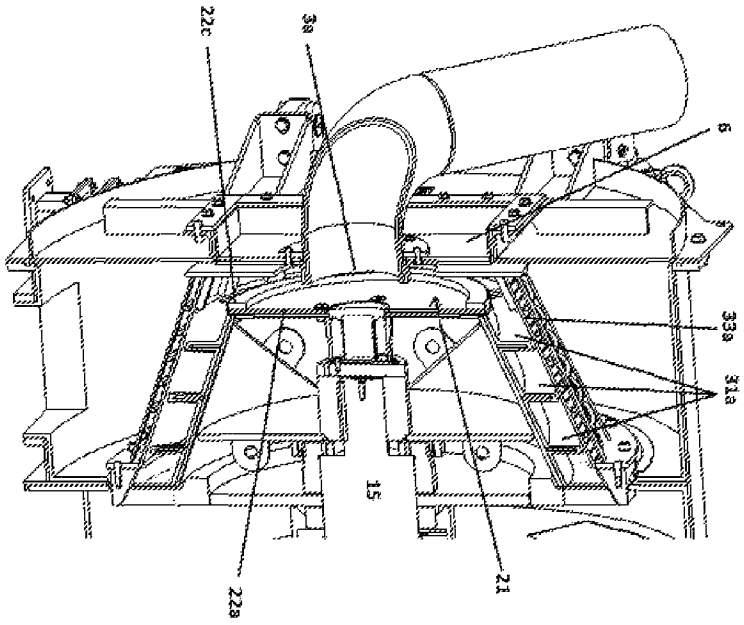
FIG. 3 is an enlarged cross sectional view of the first exemplary embodiment of the scroll screen centrifugal separator providing an enlarged view of a first exemplary embodiment of the distributor of the first exemplary embodiment of the scroll screen centrifugal separator.

Referring to FIGS. 1-3, a scroll screen centrifugal separator 1 may include a housing 4 and a feed conduit 3 connected to a moveable wall 6 of the housing. In some embodiments, the moveable wall 6 may be a door or access wall that is hingedly connected to a main body of the housing 4 via hinges 2. The housing 4 may also include feet 5 that are configured to directly contact a platform or other surface to support the housing 4.

The moveable wall 6 can be moved from an open position to a closed position. When in the open position, the wall 6 may open the housing 4 to permit an operator or other person to gain access to the cavity defined within the housing 4 to perform maintenance work or other work within the housing 4. For example, a scroll assembly 31 and screen assembly 33 can be positioned in the cavity of the housing and the wall 6 may be moved to the open position so that maintenance work relating to the replacement of repair of elements of these components may be performed. When in the closed position, the wall 6 may be moved to enclose the cavity of the housing 4 so that the material may be fed to the cavity defined by the housing 4 via a feed conduit 3 for separation of solid particulate material that is within a liquid of a slurry.

The feed conduit 3 may be a pipe, duct, or other conduit through which a slurry is passed to feed slurry to the scroll screen centrifugal separator 1 so that solid particulate material within the slurry may be separated from the liquid of the slurry. A pump or other mechanism may be connected to the feed conduit to drive movement of the slurry toward the scroll screen centrifugal separator 1. The particulate material may be a mineral or ore such as coal, gold, silver, copper, iron, or other material. The liquid of the slurry can be water or may include water or another type of liquid.

The scroll screen centrifugal separator 1 may include a motor or other type of drive unit 7. Alternatively, the scroll screen centrifugal separator 1 can be configured to be coupled to a motor or a drive unit. One type of drive unit that may be utilized is the drive assembly disclosed in U.S. Pat. No. 8,257,587. The entirety of U.S. Pat. No. 8,257,587 is incorporated by reference herein. In other embodiments, a different type of drive unit 7 may be utilized in the scroll screen centrifugal separator 1.

The drive unit 7 may include an electric motor that is configured to rotate a drive belt to drive rotation of a shaft 15 that extends into an inner cavity defined by the housing 4. The scroll assembly 31 and the screen assembly 33 are each coupled to the shaft 15 within the housing 4 such that rotation of the shaft 15 rotates a screen 33*a* of the screen assembly 33 and a scroll of the scroll assembly 31. The scroll assembly 31 and screen assembly 33 may each be connected to the shaft 15 via fasteners, welding, or other types of connection mechanisms.

The scroll assembly 31 and the screen assembly 33 can each be coupled to the shaft such that the scroll assembly 31 rotates at a speed that is different than the speed at which the screen assembly rotates. The difference in rotation between the screen assembly 33 and scroll assembly 31 can help facilitate the separation of liquid from the solid particulates within the slurry fed into the housing 4 via the feed conduit 3.

In some embodiments, the scroll assembly 31 may be coupled to the shaft 15 so that the scroll assembly 31 rotates at a speed that is greater than the speed at which the screen assembly 33 rotates. In other embodiments, the scroll assembly 31 may be coupled to the shaft 15 such that the scroll assembly 31 rotates at a speed that is less than the speed at which the screen assembly 33 rotates. The scroll assembly 31 and screen assembly 33 may be attached to the shaft 15 such that the rotational speed difference between the scroll assembly 31 and the screen assembly 33 is a fixed ratio or is adjustable so that the rotational speed differential between the screen assembly 33 and the scroll assembly 31 is variable.

Flutes 31*a* can be attached to the body of the scroll assembly such that the flutes 31*a* rotate when the scroll assembly 31 rotates via rotation of the shaft 15 driven by the drive unit 7 coupled to the shaft 15 via a drive belt or other coupling mechanism. Each scroll flute 31*a* may be attached to the body of the scroll via welding, bolts, or other types of fastening mechanisms. The scroll flutes may be curved or helical shaped members that are configured to help facilitate movement of the slurry within the cavity of the housing and within the space between the screen assembly 33 and the scroll assembly 31.

The screen assembly 33 may include a screen 33*a* that is structured as a basket or other configuration that has a plurality of apertures that are sized to permit liquid to pass through the apertures, but retain solid particulate material within the screen 33*a* so that the solid material is retained between the screen 33*a* and body of the scroll assembly 31 so that the liquid of the slurry can be expelled away from the solid particulate material and the scroll body to a position located outside of the screen 33*a*. The liquid may be moved via rotation of the scroll assembly 31 and screen assembly 33 so that the liquid is output from the cavity of the housing 4 via at least one liquid discharge outlet defined within the housing. The solid particulate material may be discharged from at least one particulate discharge outlet defined within the housing 4.

Pipes or other conduits may be connected to each liquid discharge outlet to receive the output liquid and feed that liquid to another device or mechanism. Pipes or other conduits may be connected to each particulate discharge outlet to receive the separated solid particulate material and transport that material to another device. Alternatively, a hopper or other retaining device may be positioned in alignment with each particulate discharge outlet to receive the separated solid particulate material. The particulate material may subsequently be periodically dumped out of the hopper or otherwise removed from the hopper for further transport or processing.

As may be seen from e.g. FIG. 3, a distributor 21 may be connected to the scroll assembly 31 or the shaft 15 and be positioned in the cavity of the housing 4 such that the distributor 21 is located between (i) a mouth 3*a* of the feed conduit through which slurry is fed into the cavity of the housing and (ii) all the flutes 31*a* of the scroll assembly 31 such that slurry fed into the cavity via the feed conduit 3 contacts the distributor 21 and is diverted by the distributor toward the screen 33*a* of the screen assembly 33. The distributor 21 may be coupled to the shaft 15 or scroll assembly 31 so that the distributor 21 is positioned between the scroll assembly 31 and the screen assembly 33 and rotates when the shaft 15, screen assembly 33 and scroll assembly 31 rotate via the drive unit 7. The distributor 21 may be sized and configured to direct the slurry fed into the cavity of the housing via the inlet mouth 3*a* of the feed conduit 3 so that the slurry is distributed along a preselected range of angles from the inner flat surface front face of the distributor 22*a*. The distributor 21 may be sized and configured to direct the slurry fed into the cavity of the housing via the inlet mouth 3*a* of the feed conduit 3 so that the slurry is distributed at a preselected velocity toward the screen assembly 33 that is configured to be similar to the velocity at which the screen of the screen assembly rotates (e.g. has a velocity profile in the x, y, and/or z axes that is equal to or is within 50% of the velocity profile at which the screen rotates or is a value that is between 60% of the velocity profile of the screen and 140% of the velocity profile of the screen 33*a*). The preselected velocity may be a velocity that is within a range of acceptable velocities or is within a given tolerance of a desired setpoint value or desired velocity profile value (e.g. within 10% or 20% of a selected setpoint value or desired velocity profile value). The preselected velocity may be configured to impart a preselected rotational velocity or a velocity having a rotational velocity component that is within a range of preselected rotational velocities to the output slurry so that the output slurry is already moving in a rotational direction about which the screen 33*a* is rotated. The velocity of the slurry output from the outlet of the distributor can also be slower or faster than a velocity of the slurry at which the slurry is received in the inlet of the distributor due to a configuration of one or more dams of the distributor that define passageways within the distributor through which the slurry is passable through the distributor 21 as the slurry travels from the inlet of the distributor to the outlet of the distributor. The velocity of the slurry output from the outlet of the distributor can also be slower or faster than a velocity of the slurry at which the slurry is received in the inlet of the distributor due to a configuration of a labyrinth within the slurry through which slurry passes as the slurry travels from the inlet of the distributor to the outlet of the distributor. The velocity profile of the slurry ejected from the distributor 21 can be configured to reduce sliding of the slurry across the face of the screen 33*a* to reduce wear experienced by the screen 33*a*.

Figure 4:
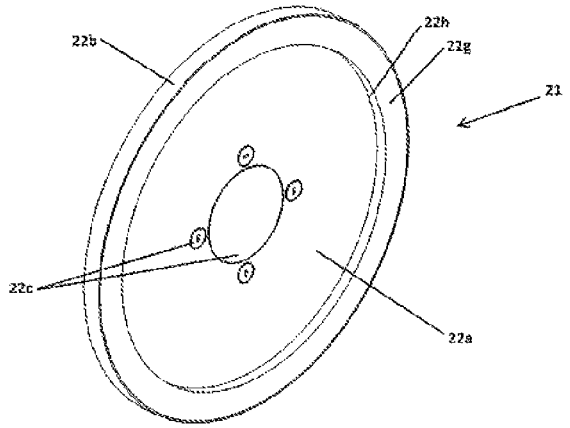
FIG. 4 is a perspective view of a first exemplary embodiment of the distributor of the first exemplary embodiment of the scroll screen centrifugal separator.
Figure 5:
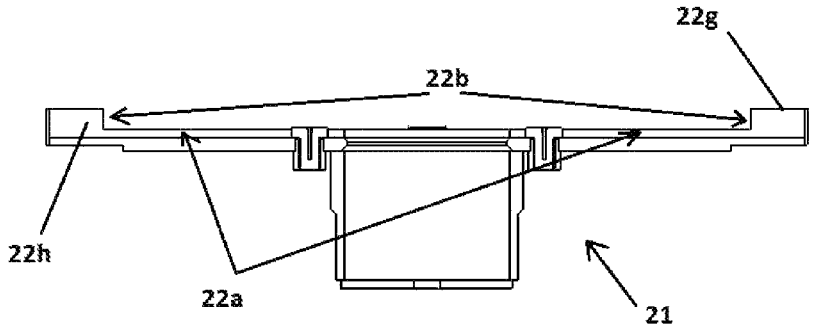
FIG. 5 is a cross sectional view illustrating a first exemplary embodiment of the distributor and portion of the scroll assembly 31 to which the first exemplary embodiment of the distributor is attached to the first exemplary embodiment of the scroll screen centrifugal separator.
Figure 6:
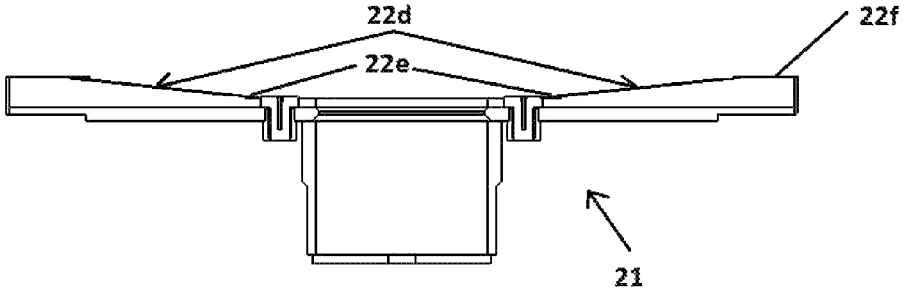
FIG. 6 is a cross sectional view similar to the view of FIG. 5 illustrating the first exemplary embodiment of the distributor and scroll assembly to which the first exemplary embodiment of the distributor is attached to a second exemplary embodiment of the scroll screen centrifugal separator that utilizes a second exemplary embodiment of a distributor.

As shown in e.g. FIG. 4, the distributor 21 may include a first plate 22 having a front face that has an inner flat surface 22*a* that is enclosed by a peripheral lip 22*b* that extends over or away from the flat surface. The peripheral lip may extend away from the flat surface 22*a* toward the mouth 3*a* of the feed conduit 3 and the front wall 6 of the housing when the wall is in the closed position by between 20 and 80 millimeters (mm), for example. In one embodiment, the lip 22*b* may extend away from the flat surface 22*a* toward the mouth 3*a* of the feed conduit 3 and the front wall 6 of the housing when the wall is in the closed position by 40 mm and have a width of 50 mm such that the peripheral lip is positioned on the outermost 50 mm of a side or face of the distributor 21. The flat surface 22*a* may extend inwardly from the peripheral lip 22*b* to the center of the distributor 21. The flat surface 22*a* may also have a plurality of holes 22*c* that are sized to receive fasteners (e.g. bolts or screws) for passing through the distributor to the shaft 15 and/or scroll assembly 31 for connecting the distributor 21 to the shaft 15 and/or scroll assembly 31.

In some embodiments, the lip 22*b* may be integrally cast or integrally formed with a plate defining the flat surface 22*a*. In other embodiments, the lip 22*b* may be a flat bar or rod-like member that has an annular shape (e.g. a ring-like shape, annular rectangular shape, or annual polygonal shape) that is welded, stitched, or otherwise fastened to a plate or other element that defines the flat surface 22*a*. The plate or other element that defines the flat surface 22*a* may be circular, oval, rounded, or polygonal in shape.

The lip 22*b* can extend a distance outwardly away from the flat surface 22*a* toward the inlet mouth 3*a* of the feed conduit 3 such that the lip 22*b* can function in a dam-like fashion to help block a portion of the slurry after it is deflected by the flat surface 22*a* to disperse the slurry along a relatively wide area of the screen 33*a* of the screen assembly 33. The dispersion of the slurry caused by the lip 22*b* can also help reduce the speed at which the slurry contacts the screen 33*a* of the screen assembly 33. The reduction in speed and dispersion of the slurry caused by the lip 22*b* can reduce the wear experienced by certain zones of the screen 33*a* so that the screen 33*a* experiences wear in a more uniform manner as compared to other conventional designs that may experience wear in certain locations at a significantly higher rate as compared to other locations due to the speed and amount of slurry diverted to those locations.

It is contemplated that the distributor 21 can be configured to include more than one lip 22*b*. For example, a first lip 22*b* may be positioned adjacent a peripheral edge of the distributor and a second lip can be located inwardly relative to the outer peripheral lip and spaced apart from the first lip to define a gap or channel between the two lips. As another alternative, the lip 22*b* may be the only lip on the distributor, but may not be located adjacent a peripheral edge. Instead the lip may be positioned inwardly between a center of the face of the distributor 21 that faces the mouth 3*a* of the feed conduit and the peripheral edge of the face of the distributor 21 that faces the mouth 3*a* of the feed conduit.

The size and shape of each lip may be rectangular in cross section or may be configured to have other shapes or dimensions. For example, each lip may have a triangular cross sectional shape or may be configured to have another type of polygonal cross sectional shape to provide a desired dispersion of slurry. As another example, the cross sectional shape of each lip may be circular, oval, rounded, or otherwise curved. The shape of the lip 22*b* may be configured to adjust an angle at which the outermost surface 22*g* of the lip 22*b* extends so that the distributor deflects slurry from the mouth 3*a* of the feed conduit to a pre-specified location or zone of locations. For instance, the outermost surface 22*g* of the lip may be configured to be planar such that the surface is a vertical surface when the distributor is mounted in the cavity of the housing 4 as shown in FIG. 1.

As another example, the outermost surface 22*g* of the lip may be configured to be curved or linearly angled relative to perfectly vertical at a pre-selected angel that is between 5° and 85° relative to perfectly vertical. For instance, the outermost surface 22*g* of the lip may be a smooth, substantially flat, linearly extending surface that is inclined or declined at an angle of between 5° and 85° or, more preferably, inclined or declined at an angle of between 15° and 60°. As yet another example, the outermost surface 22*g* of the lip may be curved and be convex or concave in shape.

As yet other examples of different types of lip configurations, the lip 22*b* may be configured so that the outermost portion surface of the lip is wider than an innermost portion 22*h* of the lip that is directly attached to the body of the distributor 21. As another example, the lip may be configured so that the outermost portion surface of the lip is thinner than the innermost portion of the lip that is directly attached to the body of the distributor 21. As yet another example, one or more lips of the distributor may be configured to have a curved shape that defines multiple grooves within the lip, such as a wave-like profile or a lip having a plurality of different spaced apart teeth defined therein.

Figure 7:
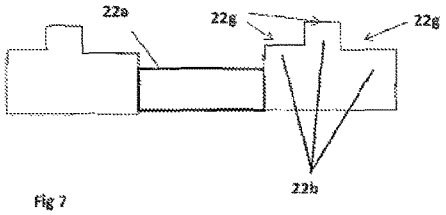
FIG. 7 is a cross sectional view of a third exemplary embodiment of a distributor that can be utilized in embodiments of the scroll screen centrifugal separator.
Figure 8:
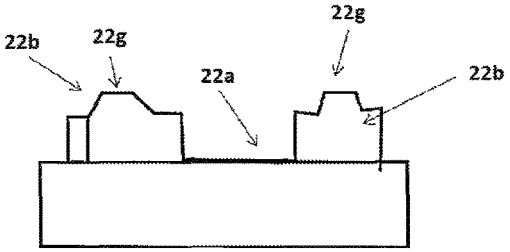
FIG. 8 is a cross sectional view of a fourth exemplary embodiment of a distributor that can be utilized in embodiments of the scroll screen centrifugal separator.
Figure 9:
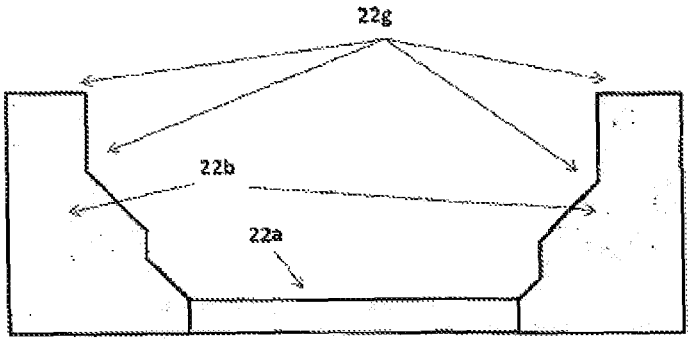
FIG. 9 is a cross sectional view of a fifth exemplary embodiment of a distributor that can be utilized in embodiments of the scroll screen centrifugal separator.
Figure 10:
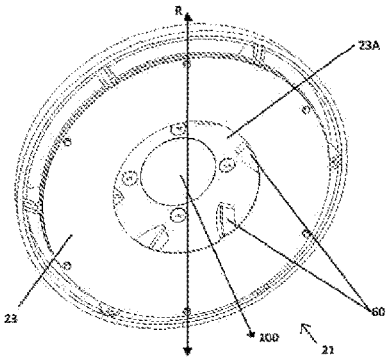
FIGS. 10-16 are perspective views of sixth and seventh exemplary embodiments of a distributor that can be utilized in embodiments of the scroll screen centrifugal separator.
Figure 11:
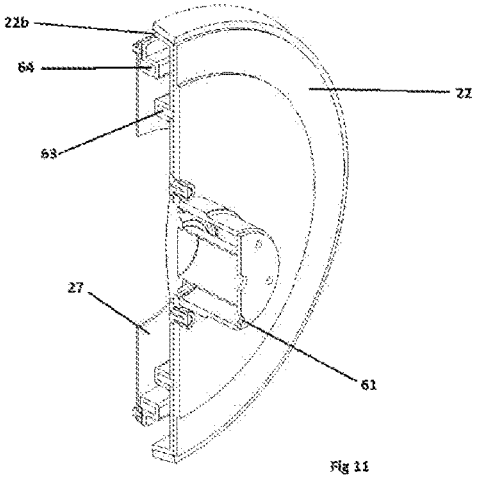
Figure 12:
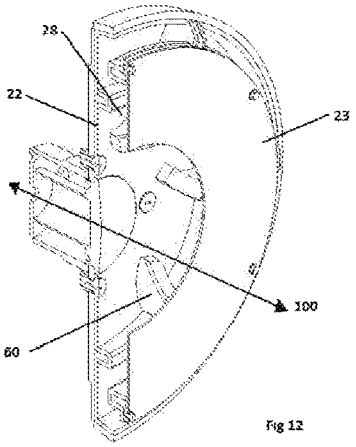
Figure 13:
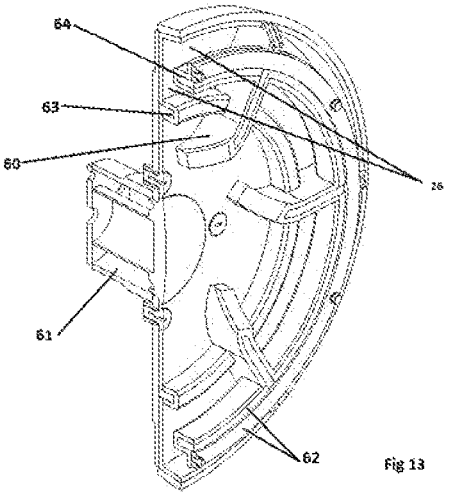

As yet other examples of different lips the distributor may have, a distributor may have one or more lips that are each integral with each other. One lip may have a lesser or greater thickness than other lips so that an outermost surface of each lip is at different distances. The change in distance at which the outermost surface extends may be configured to be staged with or without a sloped transition between them. FIGS. 7, 8 and 9 illustrate different examples of the outermost surfaces 22*g* of such lips 22*b*.

The height, length, or thickness of the lip can also be any of a number of different values. For instance, the thickness of the lip, which can define the extent to which the lip extends away from the surface 22*a* of the distributor 21, may be any of a number of possible values. Similarly, the width of the lip may be any of a number of suitable values, such as having a width of between 5-100 mm, or having a width that is greater than 100 mm or having a width that is less than 5 mm. For example, if positioned on the peripheral edge of the distributor, the lip 22*b* may therefore be positioned on the outermost 5-100 mm of the side of the distributor that faces toward the mouth 3*a* of the feed conduit 3.

In other embodiments, the distributor 21 may be configured as a plate-like member having an inclined or declined surface 22*d* such that the peripheral portion 22*f* of the surface 22*d* extends more outwardly towards the mouth 3*a* of the feed conduit 3 than the inner portion 22*e* adjacent the center of the surface 22*d* of the distributor 21. For example, a central portion or inner portion 22*e* of the distributor may only be 1-10 mm thick while the outer peripheral edge of the distributor may be between 30 and 100 mm thick such that the outer peripheral portion 22*f* of the distributor is thicker than the inner portion 22*e* of the distributor and extends further outwardly towards the mouth 3*a* of the feed conduit as compared to the inner portion 22*e* of the distributor 21. The surface 22*d* may be a generally smooth surface such as a flat or substantially flat surface that is inclined such that the surface 22*d* extends outwardly along an angle θ to the peripheral edge portion of the distributor. The angle θ may be any angle of between 1° and 65° , or more preferably at an angle of between 5° and 30°.

The inclined or declined surface 22*d* defined by the distributor 21 can facilitate the distribution of slurry and adjust an angle of impact on the screen of the screen assembly and contribute to the reducing of the energy of the impacting slurry so that the slurry is fed to a relatively inwardly located portion of the screen 33*a* while also being distributed over a larger area of the screen as compared to a distributor 21 having a flat, planar surface.

Further, it is contemplated that the discharge stream from the distributor 21 can be used to control and/or direct movement of the slurry already distributed to the screen 33*a*. This can be achieved by configuring one or more lips of the distributor 21 to direct the discharge stream of the slurry to impact at a point that impedes the natural flow of the distributed slurry. This can help hold the slurry away from a part of the screen 33*a* closest to the top of the scroll assembly 31 to facilitate the slurry being diverted toward parts of the screen 33*a* located deeper into the cavity of the housing 4.

In some embodiments, the distributor 21 of the scroll screen centrifugal separator 1 can be configured to include one or more radial arms that extend radially from a central area toward an outer portion of the distributor. Each arm 60 can be configured as a curved arm, may be a linearly extending arm, or may be a linearly extending arm that has one or more curved portions (e.g. a straight arm with a curved outer end portion). Each arm can be a unitary structure or may be a structure that is composed of multiple elements that are fastened together to form an elongated member.

One or more rings can be positioned adjacent to the arms 60. A second plate 23 that defines a first face of the distributor 21 can be spaced apart from a first plate 22 of the distributor such that the rings and arms 60 are positioned between the first and second plates 22 and 23. The second plate 23 can be a polygonal shaped member, a ring-like member or ring member that defines an inner inlet opening, such as central opening 23*a*, that is sized for receiving slurry from the feed conduit 3 and the first plate 22 can be a circular plate or plate member having a different shape (e.g. polygonal shape, elliptical shape, etc.). The first plate 22 can be a solid structure or have a continuous surface that does not have any central opening so that slurry that passes through the central opening 23*a* does not pass directly through the body of the first plate 22.

Each ring can be spaced apart from each other between the first and second plates 22 and 23 to help define passageways 26 through which slurry may pass along the distributor as the slurry is manipulated by the distributor toward the screen of the screen assembly 33.

Referring to FIGS. 10-16, an embodiment of the distributor 21 can include the second plate 23 that is spaced apart from the first plate 22. A projection 61 can be attached to the first plate 22 and can extend away from the first plate 22 for being positioned within an opening in the shaft 15 and/or scroll assembly 31 for being connected to the shaft 15 and/or scroll assembly 31. One or more fasteners or other type of fastening mechanism may be utilized to help fasten the projection 61 to the shaft 15 and/or scroll assembly 31 after the projection 61 is positioned at least partially within such an opening.

The second plate 23 may define a central opening 23*a* that is sized and configured to receive slurry from the feed conduit 3. The central opening 23*a* may be an inlet for receiving slurry to be distributed by the distributor. Slurry can be passed through the opening 23*a* to contact the first plate 22 and pass through a labyrinth defined by at least one radially extending arm 60 and one or more rings. For instance, there may be multiple labyrinth sections 62 that are each defined by at least one radially extending arm 60 that is attached to the first plate 22 and extends from adjacent the center of the first plate 22 to a location near an outer edge of the first plate 22. The arms 60 may extend radially by extending from adjacent an inner portion of the first plate 22 and/or second plate 23 to an outer portion of the first plate 22 and/or second plate 23. In some embodiments, a first side of each arm 60 is attached to the first plate 22 and the opposite second side of the arm 60 is attached to the second plate 23. In other embodiments, the arms 60 may only be attached to the first plate 22 adjacent the first side of the arm and may be spaced apart from or in contact with the second plate 23 adjacent the opposite second side of the arm 60.

Each radially extending arm 60 can have a length that extends along the y-axis shown in FIG. 1 when the distributor 21 is mounted within a horizontal scroll screen centrifuge separator 1 as shown in FIG. 2. Each arm can also have a width that is the extent to which the arm 60 extends in the x direction as shown in the axes of FIG. 1 when the distributor 21 is mounted to the scroll screen centrifuge separator 1 as shown in FIGS. 1-2. The arm 60 can also have a thickness that is defined by the extent to which the arm 60 extends in the z direction when the distributor 21 is attached to the scroll screen centrifuge separator 1 as shown in FIGS. 1-2.

The rings of the distributor can have a number of different configurations for instance, as can be seen from FIGS. 10-13.

The distributor 21 can be configured to have any number of rings and any number of radial arms 60. For instance, embodiments of the distributor 21 can be configured to include more rings or fewer rings and more arms or less arms than the distributor 21 shown in FIGS. 10-13 to define labyrinths having more gaps or fewer gaps and/or more channels or less channels.

Figure 14:
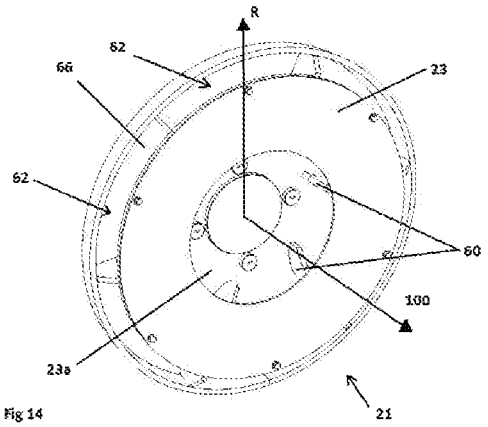
Figure 15:
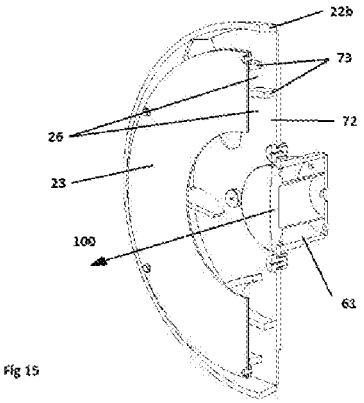
Figure 16:
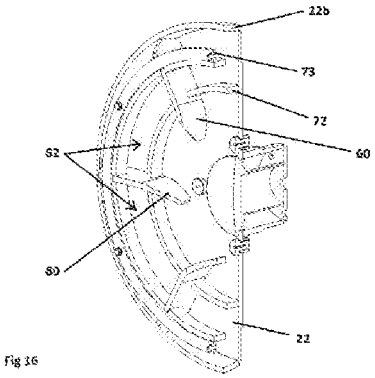
Figure 17:
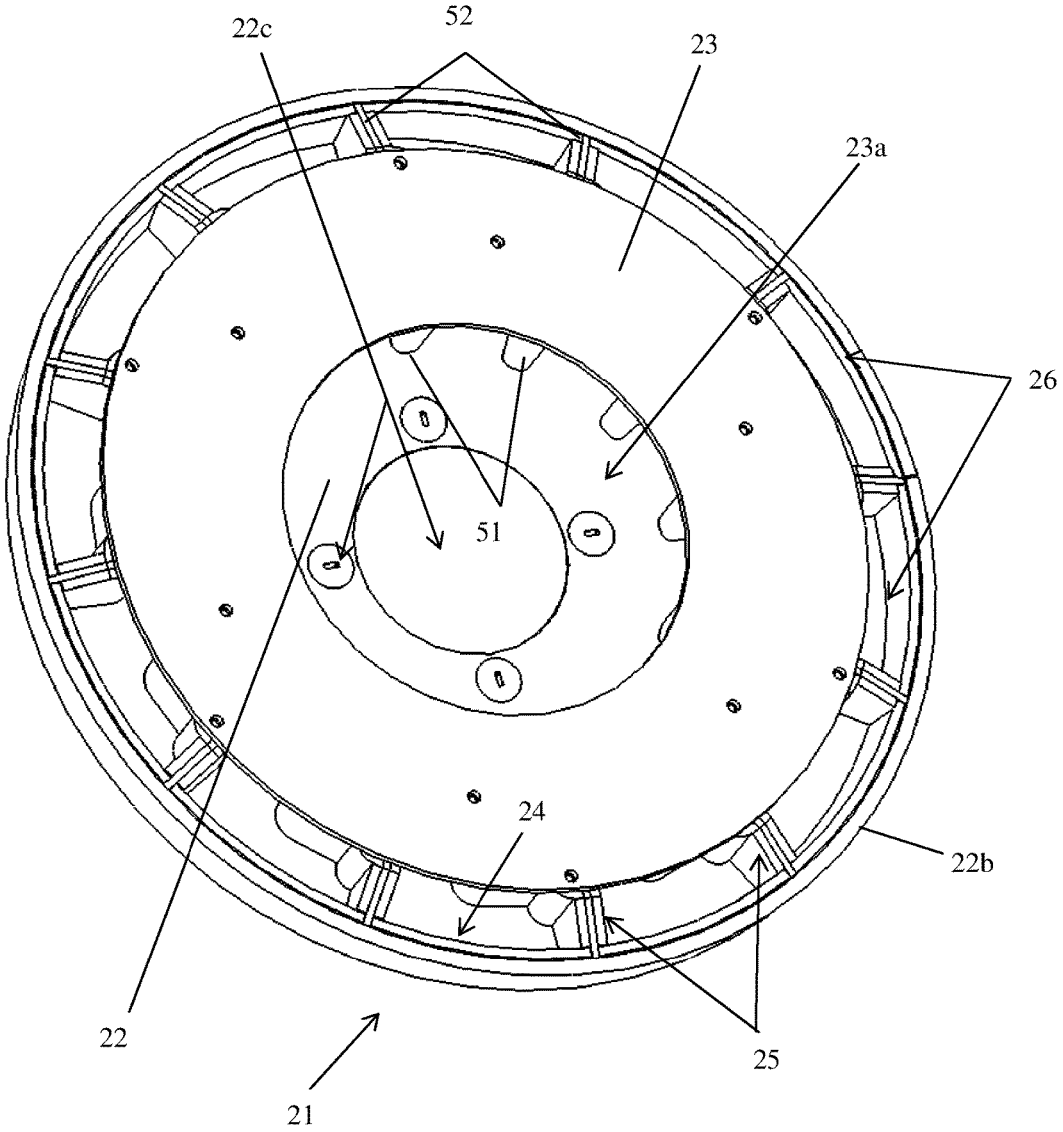
FIG. 17 is a perspective view of an eighth exemplary embodiment of a distributor that is utilized in embodiments of the scroll screen centrifugal separator.
Figure 18:
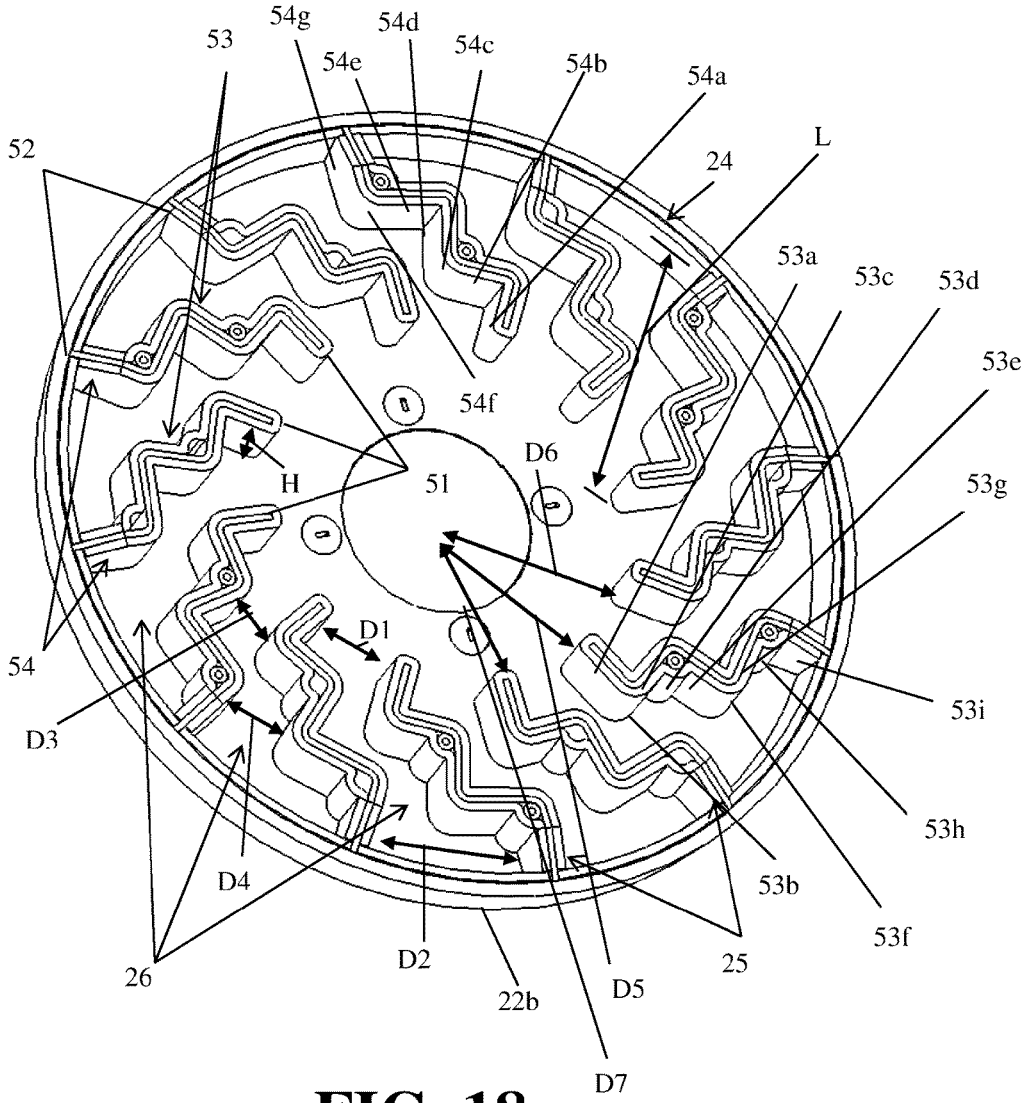
FIG. 18 is a perspective view of the eighth exemplary embodiment of the distributor with a cover plate removed to illustrate members that are spaced apart from each other on a base plate of the distributor for defining dams of the distributor.

For example, as can be seen from FIGS. 14-16, a first inner ring 72 can be attached to the first plate 22 and a second outer ring 73 can be attached to the second plate 23.

In some embodiments, the distributor 21 of the scroll screen centrifugal separator 1 can be configured to include a second plate 23, which can be configured as a cover plate, that is spaced apart from a first plate 22, which can be configured as a base plate. The second plate 23 can have a central opening 23*a* that can be configured as an inlet for the distributor 21. The first plate 22 can have plurality of holes 22*c* that are sized for receiving the shaft 15 or a connector for connecting the first plate 22 to the shaft 15. A peripheral lip 22*b* can be attached to the first plate 22 adjacent an outer peripheral edge of the first plate 22. The peripheral lip 22*b* can extend from the peripheral edge of the first plate 22 towards the second plate 23. In some embodiments, the peripheral lip 22*b* can be structured to include at least one step 24. A space can be defined between the peripheral lip 22*b* and outer peripheral edge of the second plate 23 to define the outlets of the distributor 21 through which slurry is ejected from the distributor 21.

In other alternative embodiments, the peripheral lip 22*b* can be attached to the second plate 23 adjacent to an outer peripheral edge of the second plate 23 and can extend toward the outer peripheral edge of the first plate 22. There may be a gap defined between the outer peripheral lip 22*b* and the outer peripheral edge of the second plate 23 for such embodiments that can be configured to permit slurry to be ejected from the distributor via the opening provided by that gap. Such a peripheral lip 22*b* can include one or more steps or other structure can be defined in the wall to facilitate a desired output flow of the slurry as well.

The first and second plates 22 and 23 can be structured as circular plate members or be structured as polygonal shaped members, oval shaped members, elliptical shaped members, a ring shaped member, or annular members having a polygonal, generally circular, oval, or other type of shape. The first and second plates 22 and 23 can each be composed of a metal, alloy, composite material, or other type of suitable material.

Dam members 25 for defining dams of the distributor 21 can be positioned between the first and second plates 22 and 23. The dam members 25 can be attached to the first plate 22 via one or more fasteners such as screws or bolts or other type of fastening mechanism (e.g. welds, etc.). For example, each of the dam members 25 may also be attached to the second plate 23 and/or the first plate 22 via one or more fasteners or other fastening mechanism. As another example, the dam members 25 may be integrally formed on the first plate 22 via welding or by being casted into the structure of the first plate 22 and may be fastened to the second plate 23 via screws or bolts or other type of fastener for attaching the second plate 23 to the first plate 22.

There may be any number of dam members 25 in an embodiment of the distributor 21 for meeting a particular set of design criteria.

The second plate 23 may have a central inner opening 23*a* that defines an inlet for the slurry to be received from the mouth 3*a* of the conduit 3. The first plate 22, dam members 25, and second plate 23 may be spaced apart from each other to define passageways 26 through which slurry received from the conduit 3 is passed for distributing the slurry to the screen 33*a* of the screen assembly. The slurry can be output from the distributor via outlets that are defined by the peripheral lip 22*b*, outer end portions of the dam members 25, and the first and second plates 22 and 23.

Each of the dam members 25 may be configured to extend radially along a portion of a diameter or width of the first plate 22. For example, each dam member 25 may have an inner end 51 located near a center of the first plate 22 and the central opening 23*a* of the second plate 23. Each dam 25 can also have an outer end 52 opposite its inner end 51 that is adjacent the peripheral edge of the second plate 23, peripheral edge of the first plate 22, and the peripheral lip 21*b*. Each dam member can also include a first side 53 and a second side 54 opposite the first side 53. The first and second sides 53 and 54 can extend radially along a radial length L between the top and bottom of the dam member and extend axially about a height H of the dam member 25 between the first and second plates 22 and 23. Each passageway 26 can be defined between two immediately adjacent spaced apart dam members 25 such that the first side of one of those dam members and the second side of the other one of those dam members 25 define a respective one of the passageways 26 extending from a central position of the distributor at which the slurry is received from the feed conduit 3 to the outlet of the distributor located adjacent the outer periphery of the distributor. The first and second sides 53, 54 may define differently configured surfaces to cooperate with an opposing side of the immediately adjacent spaced apart dam member 25 to define the passageway 26 between those opposite sides of the spaced apart immediately adjacent dam members 25 and the first and second plates 22 and 23 to have a particular shape and size to manipulate the velocity profile of slurry to be ejected out of the outlet of the distributor when the slurry is output from the distributor via that passageway 26 so that the ejected slurry that is distributed toward the screen 33*a* has a velocity profile within a pre-selected velocity profile range or has a pre-selected velocity profile. That pre-selected velocity profile or pre-selected velocity profile range may be configured so that the rotational velocity profile of the slurry is to more closely correspond to the rotational velocity profile of the screen 33*a* (e.g. be within 50% of the rotational velocity profile of the screen 33*a*).

In some embodiments, each dam member 25 may extend between its inner end 51 and outer end 52 such that the dam member has different segments that extend transversely to other adjacent segments as the dam member extends from adjacent the center of the first plate 22 to a location adjacent the peripheral edge of the second plate 23 and the peripheral edge of the first plate 22 and outer peripheral lip 22*b*.

Adjacent dam segments may be positioned to extend transversely, substantially perpendicularly (e.g. within 5°-30° of perpendicular, within 10°-25° of perpendicular, or within 5°-10° of perpendicular, etc.), or perpendicularly to each other via a curved connecting segment defined between the adjacent segments or a linear edge defined between the immediately adjacent segments.

For example, the first side 53 of each dam member 25 can be configured to include a first linearly extending segment 53*a* that extends from the inner end 51 to a second rounded segment 53*b*. The second rounded segment extends convexly from the first segment 53*a* to a third segment 53*c*. In alternative embodiments, the second segment 53*b* may define a concave surface or rounded or recessed surface that extends between the first and third segments 53*a* and 53*c*. The third segment 53*c* can extend linearly from the second segment 53*b* to a fourth segment 53*d*. The fourth segment 53*d* may define a convex surface on the first side 53 that extends away from the third segment 53*c* to a fifth segment 53*e*. In alternative embodiments, the fourth segment 53*d* may define a concave surface or other type of rounded or recessed surface that extends between the third and fifth segments 53*c* and 53*e*. The fifth segment 53*e* may extend linearly away from the fourth segment 53*d* to a sixth segment 53*f*. The sixth segment 53*f* may convexly extend away from the fifth segment 53*e* to a seventh segment 53*g*. In alternative embodiments, the sixth segment 53*f* may extend concavely between the fifth and seventh segments 53*e* and 53*g* or may extend to define a recessed surface or other type of rounded surface between the fifth and seventh segments 53*e* and 53*g*. The seventh segment 53*g* may extend linearly away from the sixth segment 53*f* to an eighth segment 53*h*. The eighth segment 53*h* can convexly extend from the seventh segment 53*g* to a ninth segment 53*i*. In alternative embodiments, the eighth segment 53*h* can concavely extend from the seventh segment 53*g* to the ninth segment 53*i* or can extend to define another type of rounded or recessed segment of the first side 53 between the seventh and ninth segments 53*g* and 53*i*. The ninth segment 53*i* can extend form the eighth segment 53*h* to the outer end 52 of the dam member 21*e* adjacent the peripheral wall 21*f*. For instance, a terminal end of the ninth segment 51*i* can be located near or in contact with the peripheral lip 22*b* or define a surface that extends directly and immediately from the peripheral lip 22*b* linearly in a radially inward direction toward the eighth segment 53*h* of the first side 53 of the dam member 25.

The first through ninth segments 53*a*-53*i* of the first side 53 of each dam member may extend to define a continuous surface of the first side 53 that extends from the inner end 51 to the outer end 52 that is adjoined to the peripheral lip 22*b* or in contact with the peripheral lip 22*b*. The contour of the surface of the first side 53 can be defined by the first through ninth segments 53*a*-53*i* and be configured to provide a surface that is configured to impact slurry passing through a passageway 26 to impact that slurry and force the slurry that impacts the first side 53 backwardly (e.g. inwardly to toward the center of the first plate 22) to create a change to the flow of slurry passing through the passageway to slow or speed up the rate of speed of the slurry as it is passed through the passageway 26 toward the outlet of the distributor.

The third segment 53*c* may extend linearly at an angle of between 70° and 110° relative to the first segment 53*a*. The fifth segment 53*e* may extend linearly at an angle of between 70° and 110° relative to the third segment 53*c*. The seventh segment 53*g* may extend linearly at an angle of between 70° and 110° relative to the fifth segment 53*e* and the ninth segment 53*i* may extend linearly at an angle of between 70° and 110° relative to the seventh segment 53*g*. The rounded second and sixth segments 53*b* and 53*f* may be configured to facilitate a flow of the slurry along the first side 53 so that a portion of this slurry is fed into a center of the passageway 26 between the immediately adjacent dam members 25 that define that passageway. The rounded fourth and eight segments 53*d* and 53*h* can be configured to guide a portion of slurry toward the center of the passageway 26 as well while also defining a surface for blocking or otherwise changing the flow profile of the slurry between the rounded surface of that segment and the linear segments immediately adjacent thereto to help slow or otherwise change the flow profile of the slurry passing through the passageway 26.

The second side 54 of each dam member 25 can extend from the inner end 51 to the outer end 52 of the dam member 25. The second side 54 can be opposite the first side 53 such that the first side 53 faces a first direction and the second side 54 faces a second direction that is opposite the first direction. The second side 54 can include a plurality of segments to define a contour of the surface of the second side 54. In some embodiments, that contour may be the same or correspond to the contour of the first side 53. In other embodiments, that contour may differ from the contour of the first side 53.

For instance, the second side 54 can include a first segment 54*a* that extends linearly from the inner end 51 toward a second segment 54*b*. The second segment 54*b* extends linearly away from the first segment 54*a* at an angle that can be between 70° and 110° (e.g. at a 90° angle, an 80° angle, a 100° angle, etc.) relative to the first segment 54*a* toward a third segment 54*c*. The first and second segments may define a corner therebetween that is at the interface between the first and second segments. The second segment 54*b* may extend to a third segment 54*c*. The third segment 54*c* can be a rounded segment that extends about a convex path from the second segment 54*b* to a fourth segment 54*d*. The fourth segment 54*d* may extend linearly from the third segment 54*c* to a fifth segment 54*e*. The fourth segment 54*d* may extend linearly at an angle of between 70° and 110° relative to the second segment 54*b*. The fifth segment 54*e* can extend linearly from the fourth segment 54*d* at an angle of between 70° and 110° relative to the fourth segment 54*d* toward a sixth segment 54*f*. A corner can be defined at the interface between the fourth and fifth segments 54*d* and 54*e*. The sixth segment 54*f* can be a rounded segment such as a segment that extends convexly from the fifth segment to a seventh segment 54*g*. The seventh segment 54*g* can extend linearly from the sixth segment to the outer end 52 adjacent to the outer peripheral lip 22*b* and peripheral edges of the first plate 22 and second plate 23. The seventh segment 54*g* may extend linearly at an angle of 70° and 110° relative to the fifth segment 54*e*. In some embodiments, the rounded third and/or sixth segments 54*c* and 54*f* can be configured to define concave or recessed shaped surfaces as an alternative to convex shaped surfaces.

The dam members 25 can each be positioned adjacent to spaced apart immediately adjacent other dam members 25 to define the passageways 26. The inner ends 51 of the dam members can be located a first distance D1 from immediately adjacent other dam members 25. The outer ends 52 can be positioned a second distance D2 from the outer ends 52 of immediately adjacent dam members 25. The first distance D1 can be smaller than the second distance D2 to facilitate a reduction in velocity of the slurry as it is passed through the passageway 26. The dam members 25 can also be configured so that immediately adjacent dam members are a third distance D3 and a fourth distance D4 away from each other at different spaced apart locations between their inner ends 51 and outer ends 52. In some embodiments, the immediately adjacent dam members 25 that are spaced apart from each other to define one of the passageways 26 may be spaced apart from each other by the third distance D3 at a location corresponding to where the second segment 53*b* of the first side 53 of one dam member and the third segment 53*c* of the second side 54 of the other dam member are located. In some embodiments, the immediately adjacent dam members 25 that are spaced apart from each other to define one of the passageways 26 can be spaced apart from each other by the fourth distance D4 at a location corresponding to where the sixth segment 53*f* of the first side 53 of one dam member and the sixth segment 54*f* of the second side of the other dam member are located.

The third distance D3 may be less than the first distance D1 and less than the second distance D2. In other embodiments, the third distance D3 could be larger than the first distance D1 and smaller than the second distance D2. The fourth distance D4 may be less than the first, second, and third distances D1, D2, and D3, could be larger than the first, second and third distances D1, D2, D3, or could be less than some of these distances and larger than others of these distances (e.g. larger than the first and third distances D1 and D3, but smaller than the second distance D2; larger than the second distance D2 but smaller than the first and third distances D1 and D3; larger than the first distance D1, but smaller than the second and third distanced D2, D3; larger than the second and third distances D2, D3, but smaller than the first distance D1; larger than the third distance D2, but smaller than the first and second distances D1, D2, etc.).

The inner ends 51 of immediately adjacent dam members can also be spaced away from a location along the first plate 22 that corresponds to the center of the central opening 23*a* that can receive slurry from a feed conduit or from a location on the first plate 22 that corresponds to the outer edge of the central opening 23*a* of the distributor by different distances. For example, an inner end 51 of a first dam member 25 can be a fifth distance D5 from the center of the first plate 22 or a location on the first plate 22 that corresponds with a location that is aligned with the outer peripheral edge of the central opening 23*a* of the second plate 23. A second dam member 25 that is immediately adjacent to this first dam member on the second side 54 of the first dam member can have its inner end 51 a sixth distance D6 from the center of the first plate 22 or a location on the first plate 22 that corresponds with a location that is aligned with the outer peripheral edge of the central opening 23*a* of the second plate 23. The fifth distance D5 may be equal to the sixth distance D6, less than the sixth distance D6, or greater than the sixth distance D6.

A third dam member immediately adjacent to the first dam member 25 on the first side 53 of the first dam member can have its inner end positioned a pre-selected distance away from the center of the first plate 22 or a location on the first plate 22 that corresponds with a location that is aligned with the outer peripheral edge of the central opening 23*a* of the second plate 23. For instance, the inner end 51 of this third dam member may be located the fifth distance D5, the sixth distance D6, or the seventh distance D7 away from the center of the first plate 22 or the location on the first plate 22 that corresponds with a location that is aligned with the outer peripheral edge of the central opening 23*a* of the second plate 23. The seventh distance D7 can be greater than the sixth distance D6 and less than the fifth distance D5 or may be greater than the fifth distance D5 and less than the sixth distance D6.

The inner ends 51 of the dam members 25 may be located such that the series of dam members are positioned in a pre-selected pattern away from the center of the first plate 22 or a location on the first plate 22 that corresponds with a location that is aligned with the outer peripheral edge of the central opening 23*a* of the second plate 23. For instance, the series of dam members 25 can be positioned such the their inner ends 51 are variably located away from the center of the first plate 22 by the fifth distance D5 and sixth distance D6 so that each dam member having an inner end that is the fifth distance D5 away from the center of the second plate 21*b* is immediately adjacent to dam member that have their inner ends a sixth distance D6 away from the center of the first plate. Each dam member having their inner ends a sixth distance D6 away from the center of the first plate 22 can also be immediately adjacent to dam members having their inner ends the fifth distance D5 from the center of the first plate.

As another example, the dam members may be arranged so that dam members having their inner ends a fifth distance D5 away from the first plate 22 is immediately adjacent on its first side 53 to a dam member having its inner end 51 a sixth distance D6 from the center of the first plate and is immediately adjacent on its second side 54 to a dam member having its inner end 51 a seventh distance D7 away from the center of the first plate 22. Each dam member having its inner end the seventh distance D7 away from the center to the first plate 22 can be immediately adjacent on its second side 54 to a dam member having its inner end 51 the fifth distance D5 away from the center of the first plate 22 and can be immediately adjacent on its first side 53 to a dam member having its inner end 51 the sixth distance D6 away from the center of the first plate 21*b*. Each dam member having its inner end 51 the sixth distance D6 away from the center of the first plate 22 can be immediately adjacent on its first side 53 to a dam member having its inner end 51 the fifth distance D5 away from the center of the first plate 22 an can be immediately adjacent on its second side 54 to a dam member having its inner end 51 the seventh distance D7 away from the center of the first plate 22.

The changes in inlet and outlet distances for each passageway 26 in addition to the first and second sides 53, 54 of the dam members that define sidewalls of the passageway that act to block, slow, or otherwise change the flow profile of the slurry as it passes through the passageway to facilitate a reduction in velocity or an increase of velocity in the slurry as it is passed through the distributor prior as well as a change to the velocity profile of the slurry (e.g. impart rotational velocities along different axes onto the slurry, etc.) prior to the slurry being ejected out of the outlet of the distributor 21. The size and shape of the outer peripheral lip 22*b* can also be configured to help direct the slurry being ejected by the distributor toward the screen 33*a* at a desired velocity profile so that the velocity profile of the slurry that is ejected from the distributor has a rotational velocity profile that can correspond or substantially correspond to the rotational velocity profile of the screen 33*a* while also have a desired velocity profile component that is in a direction passing through the screen 33*a*. For instance, the distributor may be configured such that the slurry is ejected from the distributor via the outlet of the distributor toward the screen 33*a* such that the rotational velocity profile of the slurry is equal to the rotational velocity profile of the screen 33*a*, or so that the rotational velocity profile of the slurry is in a range of between 80% of the rotational velocity profile of the screen and 120% of the rotational velocity profile of the screen 33*a*, or so that the rotational velocity profile of the slurry is in a range of between 50% of the rotational velocity profile of the screen and 150% of the rotational velocity profile of the screen 33*a*, or so that the rotational velocity profile of the slurry is a value that is within 30% of the rotational velocity profile of the screen.

It has been determined that embodiments of the distributor help define a wear profile of the screen 33*a* of the screen assembly 33 such that the screen has a substantially longer life as compared to screens of conventional scroll screen centrifuges. For instance, it has been determined that embodiments of the distributor 21 can help permit a screen 33*a* of a screen assembly 33 to have a life that is 2 or greater times longer than the life of a screen in a conventional scroll screen centrifuge.

Embodiments of the distributor 21 may be retrofitted into pre-existing conventional scroll screen centrifugal separators. For instance, an operator may have a pre-existing distributor removed from a conventional scroll screen centrifugal separators and subsequently have an embodiment of the distributor 21 attached to the shaft or scroll assembly of the scroll screen centrifugal separator. For scroll screen centrifugal separators that do not include a distributor, an embodiment of the distributor 21 may be attached to the scroll assembly or shaft of the scroll screen centrifugal separator to retrofit the scroll screen centrifugal separators with an embodiment of the distributor 21.

Further, embodiments of the distributor 21 may be sized and configured for use in vertical scroll screen centrifugal separators, angled scroll screen centrifuges (e.g. a centrifuge that rotates about an axis that is at a 45° angle relative to horizontal), or horizontal scroll screen centrifugal separators. In vertical scroll screen centrifugal separators, the surface of the distributor 21 that faces the mouth of a feed conduit to divert slurry fed into the separator may face upwardly toward the mouth of the feed conduit when connected to the shaft or scroll assembly in the cavity of a housing. The dams of the distributor may extend along a length that is transverse to the flow of slurry fed into the distributor while the height or width of the arms extends upwardly toward the mouth of the feed conduit. In horizontal scroll screen centrifugal separators, the surface of the distributor 21 that faces the mouth of a feed conduit to divert slurry fed into the separator may have a lip 22*b* or inclined surface 22*d* that extends horizontally outwardly toward the mouth 3*a* of the feed conduit 3 when mounted to a scroll assembly 31 or shaft 15 within the cavity of the housing 4. Further, in horizontal scroll screen centrifugal separators, the surface of the distributor 21 that faces the mouth of a feed conduit to divert slurry fed into the separator may be oriented such that the dams have a height or width extending horizontally (e.g. extending horizontally along a horizontal axis such as the x axis shown in FIG. 1) that extends toward the feed opening while the radial length of the dams extend transversely to this opening from a central portion of the distributor to near an outer portion of the distributor (e.g. extends vertically along a vertical axis such as the y-axis shown in FIG. 1). For the angled scroll screen centrifuges, the distributor 21 may face the mouth of a feed conduit to divert slurry at an angle that is inclined or declined relative to horizontal but is also not perfectly vertical. For angled scroll screen centrifuges, it is contemplated that the distributor 21 that faces the mouth of a feed conduit to divert slurry fed into the separator may be oriented such that the dams have a height or width extending horizontally and vertically (e.g. extending horizontally along a horizontal axis such as the x axis shown in FIG. 1 and also extending vertically along a vertical axis such as the y axis shown in FIG. 1) that extends toward the feed opening while the radial length of the dams extend transversely to this opening from a central portion of the distributor to near an outer portion of the distributor (e.g. extends along an angle about a vertical axis such as the y-axis shown in FIG. 1 and a depth or width axis such as the z-axis shown in FIG. 1).

The dams defined by the dam members 25 of the distributor 21 can be configured to adjust the velocity of the slurry so that the slurry emitted by the distributor 21 toward the screen 33*a* has a rotational velocity profile that is similar to the velocity profile of the rotating screen. For example, the dams can be configured to force the slurry backwardly against the direction of rotation so that slurry output from the distributor is output having a velocity profile that is equal to or within 50% of the velocity profile at which the screen 33*a* rotates (e.g. within 10% of the rotational velocity profile of the screen 33*a*, within 15% of the rotational velocity profile of the screen 33*a*, within 20-25% of the rotational velocity profile of the screen 33*a*, within 40% of the rotational velocity profile of the screen 33*a*, etc.). It has been determined that such a change to the velocity profile of the slurry provided by the distributor 21 can reduce wear experienced by the screen of the screen assembly 33 as the momentum of the slurry that is imparted to the screen can be greatly reduced by such a change to the velocity of the slurry provided by the distributor 21. For instance, such a change in velocity profile of the slurry output from an embodiment of the distributor can reduce the wear experienced by a screen so that the screen has a substantially longer life before requiring replacement as compared to screens of conventional scroll screen centrifugal separators (e.g. has a life that is 150% of the life of conventional scroll screen centrifugal separator separators, a life that is double the life of screens of conventional scroll screen centrifugal separator separators or a life that is triple the life of screens of conventional scroll screen centrifugal separator separators).

Conventional distributors often output slurry to a screen such that the output slurry has no rotational velocity component or almost no rotational velocity component. By imparting a rotational velocity component onto the output slurry as can be accomplished with embodiments of the distributor 21, it is contemplated that the screen 33*a* experiences less wear as the slurry contacting the screen is more closely matched to the rotational speed of the screen as compared to conventional centrifugal separator devices, which contributes to screens of the embodiments of separators with the distributor 21 having a significantly longer life than screens in conventional centrifugal separators.

It should be appreciated that embodiments of the distributor 21 may be configured in a number of different shapes and sizes to meet different sets of design criteria. For instance, the shape of the distributor outer cover plate may be any of a number of shapes to define an inlet opening of a particular dimension as desired to meet a particular set of design criteria. In some embodiments, the distributor 21 may be configured as a plate member having a flat inclined or declined surface 22*d* or may be a plate member that has a flat planar surface such as flat surface 22*a* and a lip 22*b* formed on a peripheral edge portion of the plate member. The plate member may be a circular shaped plate or may be a plate having other shapes. As another example, the numbers of dam members 25, shapes and sizes of the dam members 25, and/or the spacing between dam members 25 can be adjusted as needed to meet a particular set of design criteria. For example, the structure of the dams can have a cross-sectional shape of any type of structure such as a rectangular cross section, polygonal cross section, oval cross section, or circular cross section. As another example, the numbers of spaced apart rings and the number of radially extending arms can be any number of arms or rings that may meet a particular set of design criteria. For example, some embodiments may utilize less than six arms or more than six arms and some embodiments may utilize more than three rings or less than 2 rings. The shapes and sizes of the arms and rings can be any type of shape or size that may meet a particular set of design criteria. For example, the structure of the arm members that form each arm 60 can have a cross-sectional shape of any type of structure such as L-shaped cross-section, triangular cross-section, rectangular cross section, polygonal cross section, oval cross section, or circular cross section. As another example, each ring may be a unitary structure (e.g. a ring formed of a metal such as steel) or may be a structure formed from multiple interconnected members being fastened together to form a ring structure that is an annular structure that generally encircles a given area of the first plate 22 and/or second plate 23 or a given volume between the first and second plates 22 and 23. A ring or ring structure that is utilizable in embodiments of the distributor can be an annular structure defining a central hole or central opening that is circular, elliptical, or polygonal in shape (e.g. an annular circular structure, an annular oval structure, an annular shaped rectangular structure, an annular shaped hexagonal structure, an annular shaped octagonal structure or an annular shaped decagonal structure). The structure or ring members that form each ring can have a cross-sectional shape of any type of structure such as L-shaped cross-section, triangular cross-section, rectangular cross section, or circular cross section.

Embodiments of the distributor may be composed of any type of suitable material and made from any type of manufacturing process that can meet a particular set of design criteria. For instance, the distributor can be composed of steel, iron, ceramic material, an alloy, or a composite material. In some embodiments, the outer surface 22*a* of the distributor may be mostly smooth (e.g. at least 50% of the surface is smooth) and may be substantially flat (e.g. is mostly flat with relatively small variations of thickness of a plate member defining the surface, such as a surface having variations that are +/−1 mm or between +/−5 mm in height or thickness). In some embodiments, a trowelable type of wear resistant material may also be attached over at least portions, if not the entirety, of the distributor to improve the wearability of surfaces of the distributor that are designed to contact slurry when the distributor is installed within and in use in a centrifugal separator device. For instance, the distributor 21 may be made by casting ceramic or white iron to a desired shape for casting the entirety of the distributor. As another example, different components of the distributor 21 could be cast from a material and subsequently fastened together by one or more fastening mechanisms. After casting of the entire distributor or of different components of the distributor, portions of the distributor can be machined or otherwise processed to have a particular form, have surfaces protected by a wear resistant liner component, and/or be attached to other components of the distributor via welding, fasteners, or other fastening mechanisms or combination of fastening mechanisms.

While certain exemplary embodiments of a distributor plate and scroll screen centrifugal separator and methods of making and using the same have been shown and described above, it is to be distinctly understood that the invention is not limited thereto but may be otherwise variously embodied and practiced within the scope of the following claims.

What is claimed is:

1. A distributor for a scroll screen centrifugal separator comprising:

a first plate;

a second plate spaced apart from the first plate;

at least one arm attached to at least one of the first plate and the second plate;

at least one ring positioned adjacent the arm;

the at least one arm and the at least one ring being positioned between the first plate and the second plate to define a labyrinth therein such that slurry received by an inlet of the distributor is passable through the labyrinth toward an outlet of the distributor for directing the slurry from the outlet to a screen assembly of a scroll screen centrifugal separator;

wherein the at least one arm is comprised of a plurality of arms that are spaced apart from one another, each of the plurality of arms being attached to the second plate;

wherein the at least one ring is comprised of a plurality of spaced apart rings comprising a first ring and a second ring, the first ring attached to the second plate and positioned to define a first gap between a side of the first ring and the first plate such that slurry is passable through the first gap when the slurry is moved from the inlet to the outlet, the second ring attached to the first plate and positioned to define a second gap between a side of the second ring and the second plate such that, the slurry is passable through the second gap when the slurry is moved from the inlet to the outlet; and wherein the first ring and second ring are spaced apart from each other such that the first ring is an inner ring positioned closer to a central portion of the second plate than the second ring, the first and second rings defining a channel through which the slurry is passable as the slurry moves from the inlet to the outlet, the channel being in fluid communication with the first and second gaps.

2. The distributor of claim 1 wherein the labyrinth is configured such that the slurry emitttable from the outlet has a preselected rotational velocity profile that is within 5%-150% of a rotational velocity of a screen of the screen assembly.

3. The distributor of claim 1 wherein the second plate has a projection that is sized and configured for being received within at least one of a shaft and a scroll assembly of a scroll screen centrifugal separator.

4. The distributor of claim 1 further comprising:

an outer wall attached to the first plate to surround the first plate, the outer wall being spaced apart from the second plate to define the outlet; and wherein the channel and the first and second gaps are portions of the labyrinth and at least partially define a path of travel for the slurry through the labyrinth as the slurry passes from the inlet to the outlet, the inlet being defined by the first plate.

5. The distributor of claim 1 wherein the first plate is a ring member that defines the inlet, the second plate is a circular plate member, and each of the at least one ring is an annular structure.

6. The distributor of claim 5 wherein each of the at least one arm is an elongated member that extends radially from adjacent an inner portion of the second plate to an outer portion of the second plate.

7. The distributor of claim 5 wherein at least a portion of the member of the at least one arm is curved.

8. A distributor for a scroll screen centrifugal separator comprising:

a first plate;

a second plate spaced apart from the first plate;

at least one arm attached to at least one of the first plate and the second plate;

at least one ring positioned adjacent the arm;

the at least one arm and the at least one ring being positioned between the first plate and the second plate to define a labyrinth therein such that slurry received by an inlet of the distributor is passable through the labyrinth toward an outlet of the distributor for directing the slurry from the outlet to a screen assembly of a scroll screen centrifugal separator;

wherein the at least one ring is comprised of a plurality of spaced apart rings comprising a first inner ring, a second intermediate ring, and a third outer ring, the first inner ring being attached to the second plate and positioned to define a first gap between a side of the first inner ring and the first plate such that the slurry is passable through the first gap as the slurry is moved from the inlet to the outlet, the second intermediate ring being attached to the first plate and positioned between the first and third rings, the second ring positioned to define a second gap between a side of the second ring and the second plate such that the slurry is passable through the second gap when the slurry is moved from the inlet to the outlet, and the third outer ring being attached to the second plate and positioned to define a third gap between a side of the third outer ring and the first plate such that the slurry is passable through the third gap as the slurry is moved from the inlet to the outlet.

9. The distributor of claim 8 wherein:

the first and second rings being spaced apart from each other to define a first channel through which the slurry is passable, the first channel being in fluid communication with the first and second gaps; and the second and third rings being spaced apart from each other to define a second channel through which the slurry is passable, the second channel being in fluid communication with the second and third gaps.

10. The distributor of claim 9 further comprising:

an outer wall attached to the second plate to surround a periphery of the second plate, the second wall being spaced apart from an outer edge of the first plate to define the outlet.

11. The distributor of claim 10 wherein the first and second channels and the first, second and third gaps are portions of the labyrinth.

12. A scroll screen centrifugal separator comprising:

a housing;

a feed conduit connected to the housing, the feed conduit having a mouth through which slurry is fed into a cavity of the housing;

a screen assembly mounted within the cavity of the housing for driven rotation within the housing;

a scroll assembly mounted for driven rotation within the cavity of the housing, the scroll assembly being positioned within the screen assembly, and a distributor positioned between the feed conduit and the scroll assembly, the distributor comprising:

a first plate;

a second plate spaced apart from the first plate;

at least one arm attached to at least one of the first plate and the second plate;

at least one ring positioned adjacent the arm;

the at least arm and the at least one ring positioned between the first plate and the second plate to define a labyrinth therein such that the slurry received by an inlet of the distributor is passable through the labyrinth toward an outlet of the distributor for directing the slurry from the outlet to a screen assembly of a scroll screen centrifugal separator.

13. The scroll screen centrifugal separator of claim 12 wherein the scroll screen centrifugal separator is a horizontal scroll screen centrifugal separator or is a vertical scroll screen centrifugal separator.

14. The scroll screen centrifugal separator of claim 12 wherein the at least one arm is comprised of a plurality of arms that are spaced apart from one another, each of the plurality of arms being attached to the second plate;

wherein the at least one ring is comprised of a plurality of spaced apart rings comprising a first ring and a second ring, the first ring attached to the second plate and positioned to define a first gap between a side of the first ring and the first plate such that the slurry is passable through the first gap when the slurry is moved from the inlet to the outlet, the second ring attached to the first plate and positioned to define a second gap between a side of the second ring and the second plate such that the slurry is passable through the second gap when the slurry is moved from the inlet to the outlet; and wherein the first ring and second ring are spaced apart from each other such that the first ring is an inner ring positioned closer to a central portion of the second plate than the second ring, the first and second rings defining a channel through which the slurry is passable as the slurry moves from the inlet to the outlet, the channel being in fluid communication with the first and second gaps.

15. The scroll screen centrifugal separator of claim 14 wherein the distributor further comprises:

an outer wall attached to the first plate to surround the first plate, the outer wall being spaced apart from the second plate to define the outlet; and wherein the channel and the first and second gaps are portions of the labyrinth and at least partially define a path of travel for the slurry through the labyrinth as the slurry passes from the inlet to the outlet, the inlet being defined by the first plate.

16. The scroll screen centrifugal separator of claim 12 wherein the labyrinth is configured such that the slurry emitttable from the outlet has a preselected rotational velocity profile that is within 5%-150% of a rotational velocity of a screen of the screen assembly.

17. The scroll screen centrifugal separator of claim 12 wherein the second plate has a projection that is sized and configured for being received within at least one of a shaft and a scroll assembly of a scroll screen centrifugal separator.

18. The scroll screen centrifugal separator of claim 12 wherein the at least one ring is comprised of a plurality of spaced apart rings comprising a firs inner ring, a second intermediate ring, and a third outer ring, the first inner ring being attached to the second plate and positioned to define a first gap between a side of the first inner ring and the first plate such that the slurry is passable through the first gap as the slurry is moved from the inlet to the outlet, the second intermediate ring being attached to the first plate and positioned between the first and third rings, the second ring positioned to define a second gap between a side of the second ring and the second plate such that the slurry is passable through the second gap when the slurry is moved from the inlet to the outlet, and the third outer ring being attached to the second plate and positioned to define a third gap between a side of the third outer ring and the first plate such that the slurry is passable through the third gap as the slurry is moved from the inlet to the outlet.

19. The scroll screen centrifugal separator of claim 12 wherein the first plate is a ring member that defines the inlet, the second plate is a circular plate member, and each ring is an annular structure.

* * * * *